US006212697B1

(12) United States Patent
Parsons et al.

(10) Patent No.: US 6,212,697 B1
(45) Date of Patent: Apr. 10, 2001

(54) AUTOMATIC FLUSHER WITH BI-MODAL SENSITIVITY PATTERN

(75) Inventors: Natan E. Parsons, Brookline; Haiou Wu, Jamaica Plain, both of MA (US)

(73) Assignee: Arichell Technologies, Inc., West Newton, MA (US)

( * ) Notice: Subject to any disclaimer, the term of this patent is extended or adjusted under 35 U.S.C. 154(b) by 0 days.

(21) Appl. No.: 09/390,897

(22) Filed: Sep. 7, 1999

(51) Int. Cl.[7] ..... E03D 13/00

(52) U.S. Cl. ..... 4/302; 4/304; 4/305; 4/406; 250/221; 250/216

(58) Field of Search ..... 4/302, 304, 305, 4/406, 313, DIG. 3; 251/129.04; 250/221, 222.1, 216; 340/555, 565; 359/664, 720

(56) References Cited

U.S. PATENT DOCUMENTS

| | | | | |
|---|---|---|---|---|
| 4,309,781 | * | 1/1982 | Lissau | 4/304 |
| 4,823,414 | | 4/1989 | Piersimoni et al. | 4/623 |
| 4,894,874 | | 1/1990 | Wilson | 4/623 |
| 4,941,219 | * | 7/1990 | Van Marcke | 4/623 |
| 4,998,673 | | 3/1991 | Pilolla | 239/67 |
| 5,025,516 | | 6/1991 | Wilson | 4/623 |
| 5,074,520 | | 12/1991 | Lee et al. | 251/40 |
| 5,169,118 | | 12/1992 | Whiteside | 251/30.03 |
| 5,412,816 | | 5/1995 | Paterson et al. | 4/623 |
| 5,539,198 | | 7/1996 | McMichael et al. | 250/221 |
| 5,548,119 | | 8/1996 | Nortier | 250/341.1 |
| 5,555,912 | | 9/1996 | Saadi et al. | 137/801 |
| 5,566,702 | | 10/1996 | Philipp | 137/1 |
| 5,901,384 | | 5/1999 | Sim | 4/313 |
| 5,950,983 | * | 9/1999 | Jahrling | 251/129.04 |
| 5,979,500 | * | 11/1999 | Jahrling et al. | 4/623 |

* cited by examiner

*Primary Examiner*—Gregory L. Huson
*Assistant Examiner*—Tuan Nguyen
(74) *Attorney, Agent, or Firm*—Cesari and McKenna, LLP

(57) ABSTRACT

In an automated flush system (10), a control circuit (12) controls a flusher (16) in response to the output of a sensor (14). The vertical sensitivity pattern (24) of the sensor (14) is angled downward. Consequently, radiation that the sensor (14) emits tends to be reflected away from the sensor (14) by relatively specular vertical enclosure surfaces such as that of a stall door (18), while more-diffuse deflectors, such as a user that the sensor (14) is intended to detect, tend to reflect greater percentages of the sensor radiation back to the sensor (14). Similarly reduced sensitivity to enclosure surfaces results from a horizontal sensitivity pattern (40) having a reduced-sensitivity central region. The sensor system can thereby more reliably avoid confusing enclosure surfaces with users, on whose detection the system's automatic flush strategy is based.

28 Claims, 4 Drawing Sheets

AUTOMATIC FLUSHER WITH BI-MODAL SENSITIVITY PATTERN

BACKGROUND OF THE INVENTION

The present invention concerns automatic flush systems and is directed particularly to sensor apparatus that they employ.

Technological advances in recent years have made the use of automatic flushers quite popular in public facilities. Although they have been employed for both toilets and urinals, their use for urinals has been much more widely accepted than for toilets, because automatic urinal flush systems have tended to be more reliable than automatic toilet flush systems.

One reason why toilet flushers tend to be less reliable is that toilets tend to be placed in stalls. This requires the object detectors on whose operation automatic flushers are based to distinguish between actual users and stall surfaces. Although ways of making this distinction exist, they tend to be relatively complicated, costly, and inconvenient.

SUMMARY OF THE INVENTION

We have found that the difficulty presented by such enclosures can be greatly reduced by employing a sensor system that in plan view has a bimodal sensitivity pattern. Specifically, the sensor is significantly less sensitive in a central region, where the sensor radiation's angle of incidence on a stall door is more nearly normal, than immediately to that region's left and right, where it is less so. This tends to reduce responsiveness to enclosure surfaces in comparison with user surfaces. The reason for this result appears to be that surfaces such as those of stall doors tend to reflect more specularly than those of the desired target, namely, the user. This means that the stall door reflects less light back to the source than a user does when the incident light forms a large angle with the surface normal. This feature is particularly beneficial if the sensor's sensitivity-pattern maxima that flank the central region are spaced apart in front of the toilet bowl by an amount that matches the spacing of a typical user's legs, which are the sensor's typical targets.

Another aspect of the present invention takes further advantage of the tendency of enclosure surfaces to be more specular than user surfaces. According to this aspect of the invention, the sensor system's sensitivity pattern is directed at a downward angle rather than horizontally. This, too, tends to result in angles of incidence that differ significantly from perpendicular and therefore produce relatively little retroreflection from surfaces that reflect somewhat specularly.

A further reason for this aspect's advantage seems to be that it reduces the sensor's sensitivity to motions of a user seated on the toilet. Since the sensor pattern is directed at a downward angle, the sensor tends to respond less to the user's upper back, which tends to move most, and more to the user's lower back, which tends not to move as much.

We have found that employing such directional sensitivity patterns greatly reduces the difficulties of implementing automatic flush systems in enclosed environments.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
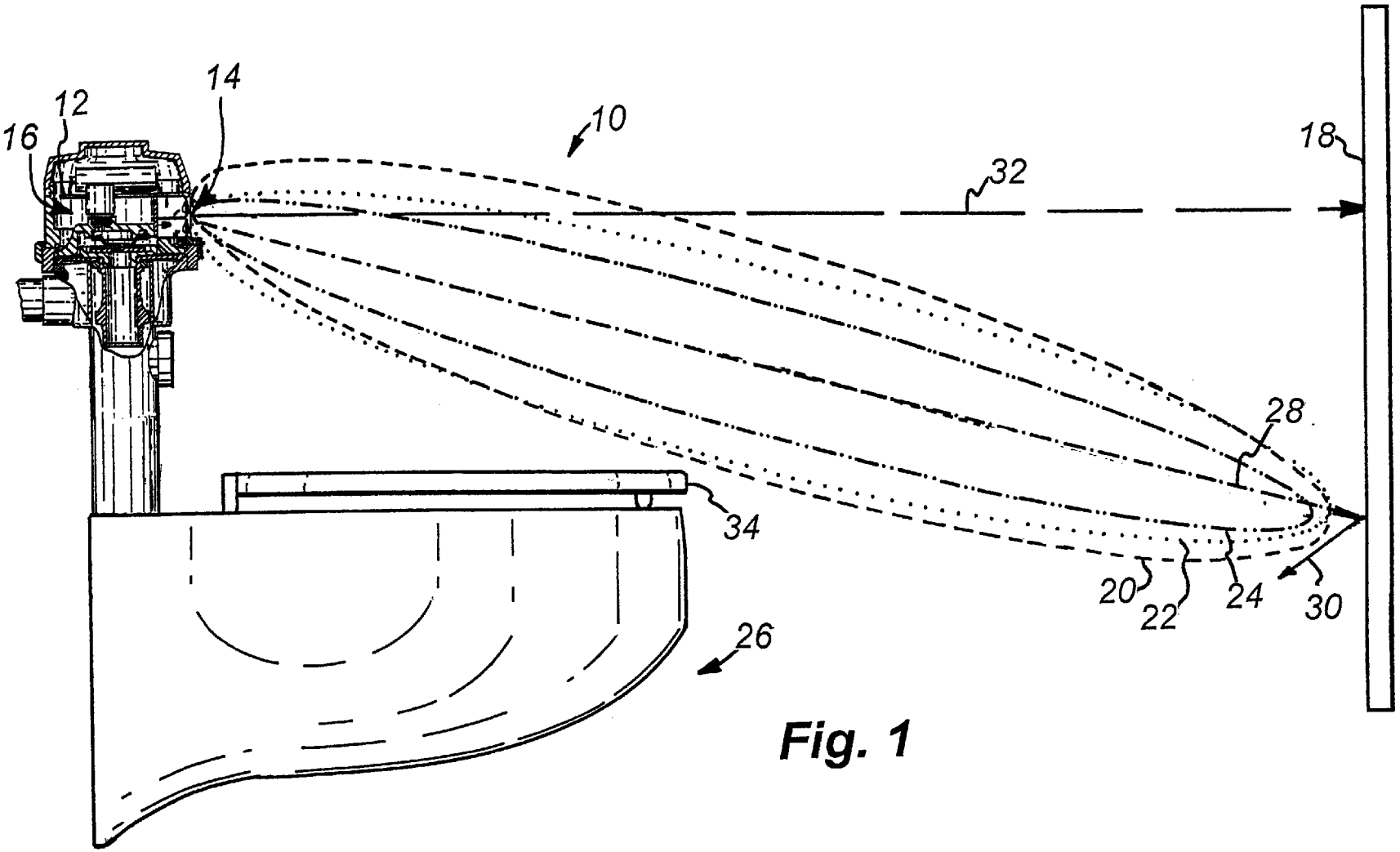
FIG. 1 is a side view of an automatic-toilet system that embodies the present invention's teachings.

An automatic toilet system 10 includes a control circuit 12 that responds to a sensor system 14 in determining when to trigger a solenoid-operated flusher 16. The particular control strategy that circuit 12 employs is not relevant to the invention, but it typically involves assuming an armed state when a user is detected and then, from the armed state, triggering a flush when it no longer detects a user's presence.

To detect a user, the sensor emits some type of wave disturbance, typically an infrared beam, that will be reflected by a user back to the sensor. The problem presented by enclosure-system surfaces, such as that of a stall door 18, is that they, too, can reflect radiation and thereby confuse the control circuit 12.

The illustrated embodiment reduces such confusion by employing two aspects of the present invention. FIG. 1 illustrates one of those aspects. It shows the sensor's receiver tansmitter radiation pattern 20 as well as its transmitter pattern 22. The latter pattern gives the relative values of radiant flux density, i.e., radiant power per unit area, as a function of angle. The former pattern gives the radiation detector's response, in output current per unit flux density, as a function of angle. Those patterns' product is the sensor's overall sensitivity pattern 24. Since the sensor and receiver positions do not exactly coincide, the pattern's shape depends somewhat on distance from the sensor. But plot 24 reasonably approximates the pattern at most locations beyond the front of the toilet bowl 26.

As FIG. 1 indicates, the sensor transmits relatively little radiation horizontally, i.e., toward objects at the same height as the sensor 14. Its sensitivity to radiation reflected from such objects is similarly low. So it is not as sensitive to objects located at that height as it is to objects lower down. (As those skilled in the art will recognize, of course, a downward tilt in the overall sensitivity pattern can be achieved by directing only one or the other pattern downward, but having both incline downward is preferable.)

An advantage of this downward direction results from the fact that the reflection from stall doors tends to be relatively specular. That is, the angle of reflection of a very large percentage of radiation that a stall door receives tends to be nearly equal to its angle of incidence. Light ray 28, for instance, tends to be reflected in a relatively narrow plume centered on ray 30. This means that very little of the sensor radiation that strikes the stall door 18 is reflected back to the sensor. In a more-conventional system, on the other hand, a large percentage of the light would shine at the stall door 18 in directions not far from the one that ray 32 illustrates. The plume that would result from such a ray would be centered on the sensor, making it relatively sensitive to the stall door 18's presence.

Because the radiation pattern is directed downward, the radiation will tend to strike the user at angles similar to those at which it strikes the stall door 18. But users' clothes tend to reflect more diffusely, i.e., less specularly, than a stall door or other enclosure wall. So the reflection plume will tend to be wider, making the sensor more sensitive to users than to, say, a stall door.

Much of the advantage of this aspect of the invention can be obtained through sensitivity patterns that differ markedly from the one that FIG. 1 depicts. Preferably, though, less than 12% of its sensitivity pattern should extend above the horizontal. That is, if the pattern is integrated through all angles in a vertical plane, the portion of the result that upward angles produce should be less than 12%. In most embodiments, the center of the pattern will form an angle of at least 5 degrees with the horizontal.

The sensor system's downward tilt has another advantage. Criteria in many control strategies involve target-position changes in some fashion. It turns out that motions of a user's upper back tend to be less informative for this purpose than those of his lower back. By using a downward inclination, the sensor can make the system more responsive to the latter than to the former. To maximize this effect, we arrange the sensor system so that the percentage of the pattern between 3 inches and 12 inches above the toilet seat is at least 1.5 times the percentage of the pattern between 12 inches and 21 inches above the toilet seat in a region somewhere in a range between 2 inches and 15 inches behind front of the toilet.

Further reliability results if the sensor's sensitivity to the toilet itself is suppressed. For this reason, we prefer that less than 20% of the sensitivity pattern extend below the angle that intersects the toilet edge 34.

Figure 2:
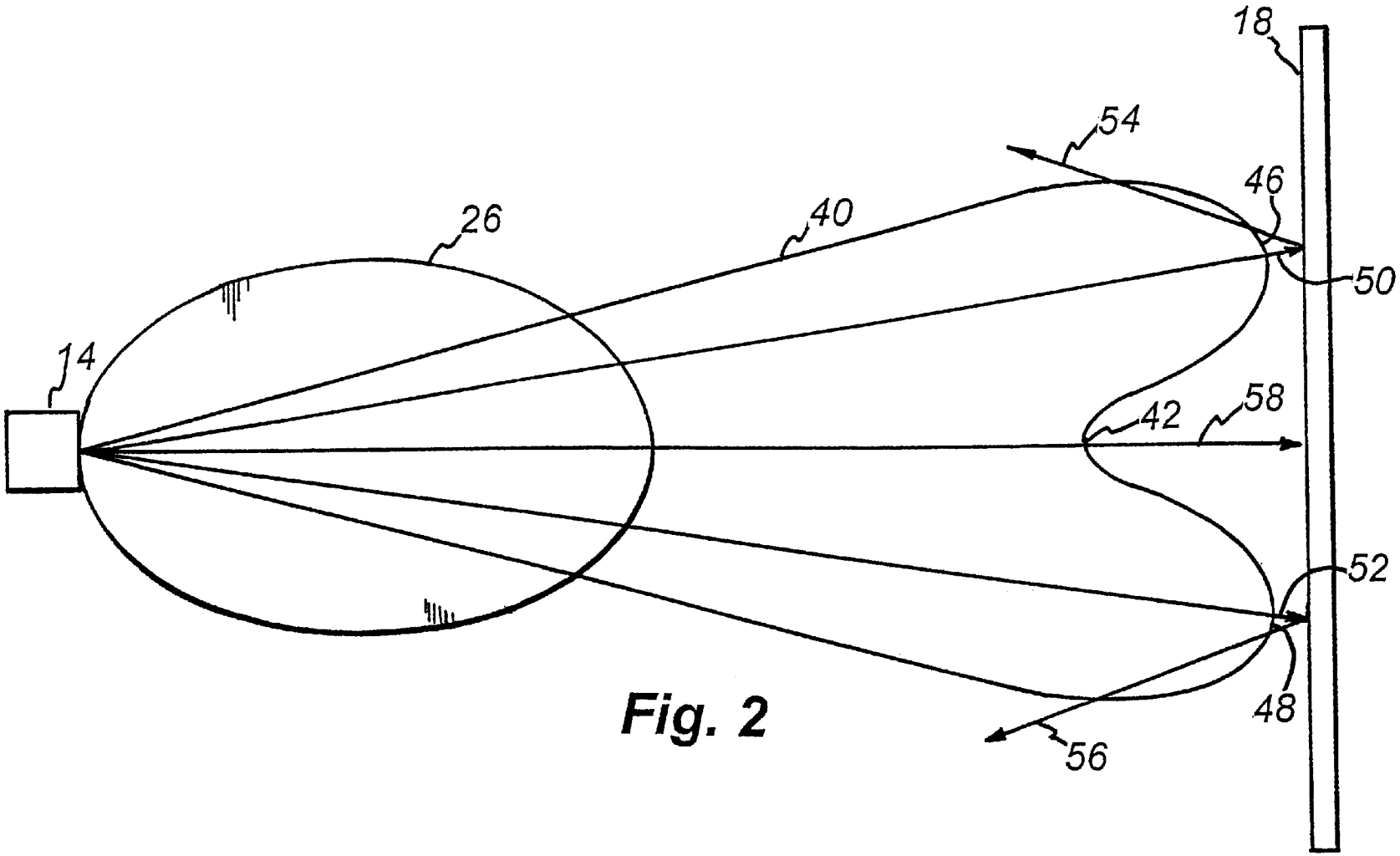
FIG. 2 is a plan view of the automatic-toilet system.

As FIG. 2 illustrates, the present invention takes advantage of the above mentioned tendency of enclosure surfaces to reflect more specularly than users. Plot 40 can be thought of as a plane view of the sensitivity pattern. More precisely, it is the component of the pattern in a plane normal to a vertical plane and containing in a line such as the one that FIG. 1's ray 28 represents. According to the invention, the sensitivity pattern has a local minimum 42 in a central region of the pattern, i.e., in a region of the pattern for which the percentage of the pattern to its left equals the percentage of the pattern to the right. The pattern exhibits maxima 46 and 48 to the left and the right of the central portion. Both maxima have values that are greater than any value within the central region.

Because of enclosure surfaces' tendency to reflect in a relatively specular manner, plumes resulting from incident rays 50 and 52—and therefore centered on rays 54 and 56, respectively—tend to be relatively narrow. That is, most resultant reflection is directed away from the sensor 14. In contrast, although the reflection from ray 58 tends to be centered in a direction that leads toward sensor 14, the amount of radiation transmitted in directions near to ray 58 is small, and the sensor's sensitivity to rays that reach it from that direction is low. Moreover, FIG. 2 shows the directions only in plane view, and, as FIG. 1 shows, even the rays that appear to be directed back toward sensor 14 actually tend to be directed downward, away from it.

The particular relationship of the central minimum to the maxima on either side is not critical to achieving the present invention's advantages. Of course, it is desirable to suppress the central part of the sensitivity pattern to as a great a degree as possible. As the drawing indicates, though, sensitivity in that region need not be suppressed entirely. Still, the central minimum should be no greater than 80% of the maximum outside the central region.

Additionally, there is no particularly critical angular offset that is required between the two maxima. The angle will depend greatly on the particular sensor placement and other details of the individual installation. But it is best for the maxima to be between 3 and 14 inches apart somewhere within 30 inches in front of the toilet bowl. This corresponds to a typical distance between the center points of a user's legs, which are often the sensor's primary targets.

Those skilled in optics can readily produce patterns that have the salient features emphasized above. Various systems of lenses, reflectors, baffles, etc., can be employed to achieve such a result and implement the present invention's teachings. FIGS. 3–6 depict one such system.

Figure 3:
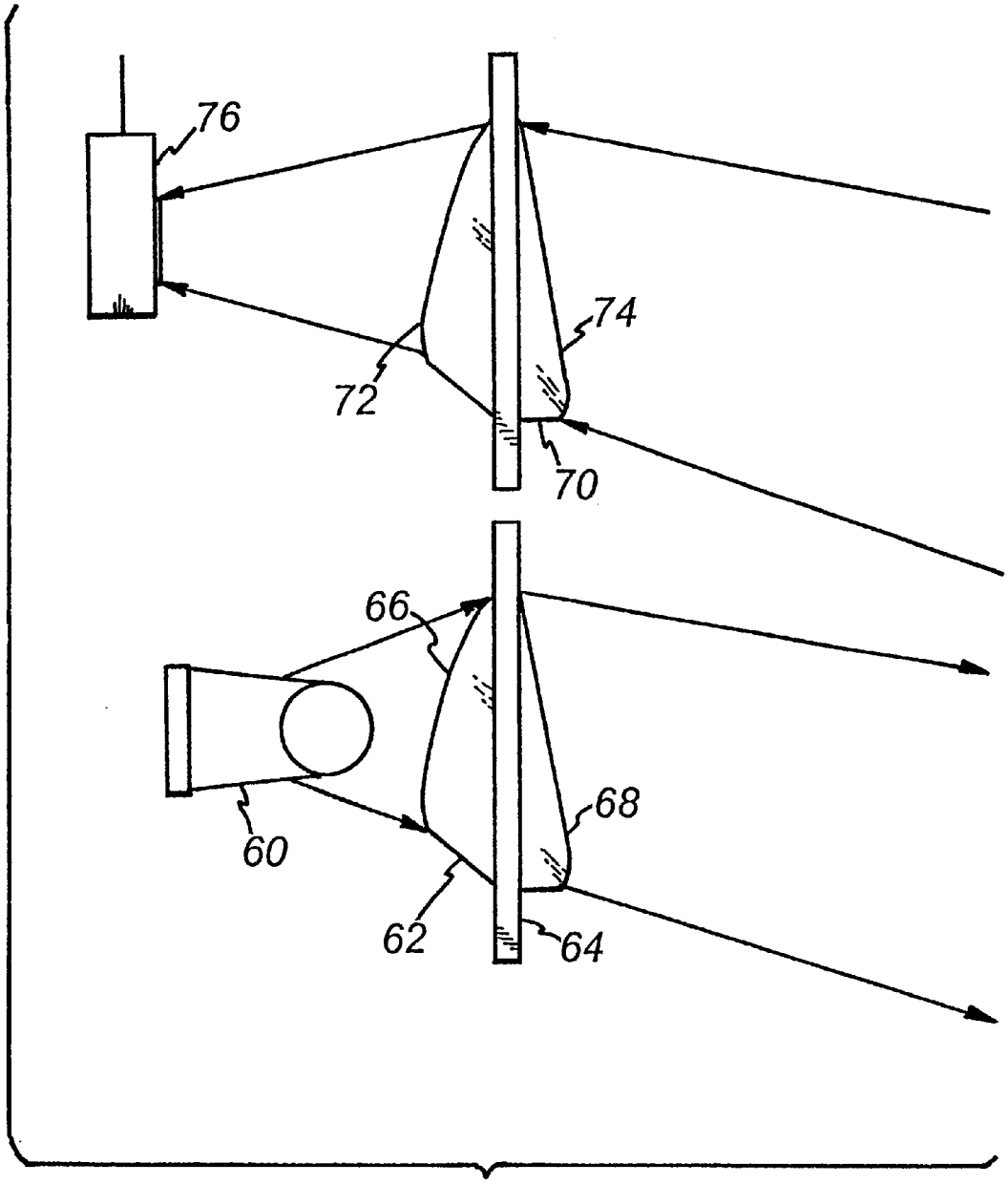
FIG. 3 is a side elevation of the lenses employed in the sensor system that the automatic-toilet system employs.
Figure 4:
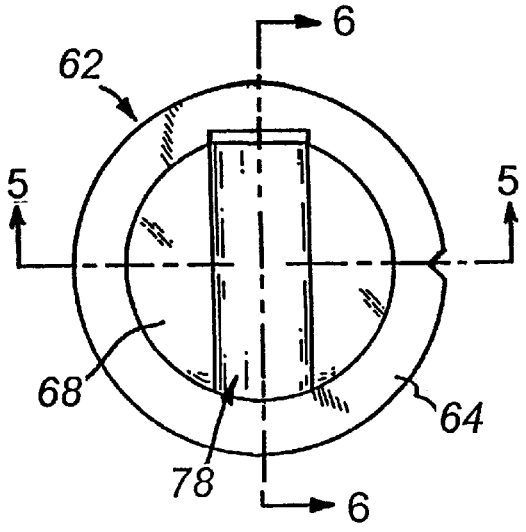
FIG. 4 is a front elevation of the sensor system's transmitter lens.

FIG. 3 depicts the illustrated embodiment's sensor arrangement. A source 60 in the form of, say, an infrared-light-emitting-diode is disposed behind a lens 62. FIG. 4 is a front view of lens 62. In that view, the optically useful part of the lens is generally circular, being centered within a flange portion 64 employed for mounting the lens in a housing that FIGS. 3 and 4 omit. That central circular portion is approximately half an inch in diameter. FIG. 3 shows that lens 62 forms rear surface 66. That surface is spherically convex, having a 0.63-inch radius of curvature and a peripheral edge that defines a plane normal to a line that extends downward to the right at an angle of 18.6 degrees with the horizontal. The lens's front, exit surface 68 is also spherically convex, having a 2.0-inch radius of curvature and a peripheral edge that defines a plane normal to a line that extends downward to the left at an angle of 9.8 degrees with the horizontal. With the source positioned as shown, this results in a radiation pattern similar to the one that FIG. 1's plot 22 depicts.

With one exception to be described below, the shapes of a receiver lens 70's left and right faces 72 and 74 are the same as those of the transmitter lens 62's corresponding surfaces 66 and 68. They collect light received from the target and tend to direct it toward a radiation detector 76, such as a photodiode. This arrangement is responsible for FIG. 1's receiver pattern 20.

Although the illustrated positions of the source 60 and detector 76 with respect to their respective lenses contribute to determining the sensor pattern, it is sometimes desirable to locate those elements and the other electronics remotely from the lenses' somewhat hostile environment. In such cases, it may be preferable to produce similar patterns by running fiber-optic cables from the lens positions to a remote source and detector.

Figure 5:
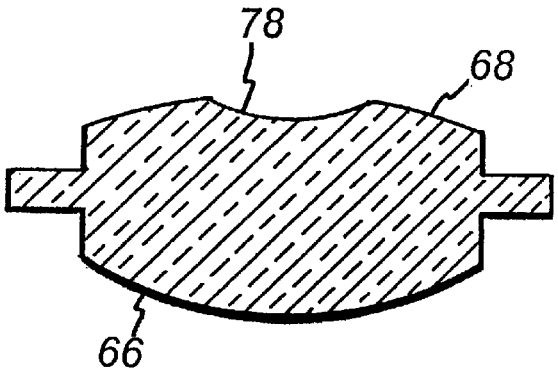
FIG. 5 is cross-section taken at line 5—5 of FIG. 4 with curvatures exaggerated for the sake of explanation.
Figure 6:
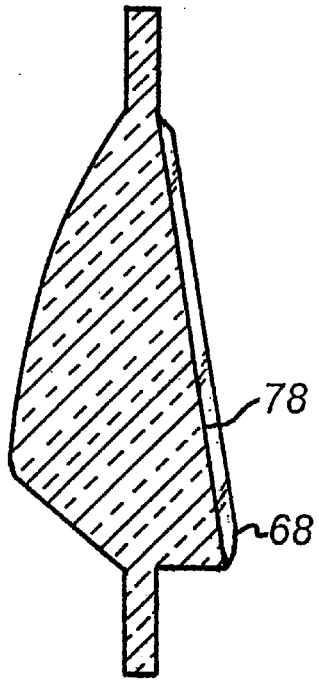
FIG. 6 is cross-section taken at line 6—6 of FIG. 4.

As FIG. 4 shows, the illustrated embodiment's lens 62 differs from lens 70 in that the transmitter lens 62's surface 68 includes a central groove 78, which is responsible for the bimodal pattern that FIG. 2 depicts. Groove 78's surface is concave, as FIG. 5 illustrates by exaggerated surface curvatures. In FIG. 5, surface 68's curvature is detectable, as is that of groove 78. Surface 68's curvature is not as detectable in FIG. 6, since FIG. 6 does not exaggerate the curvatures. As was mentioned above, though, surface 68's curvature is spherical, so it actually has the same curvature in both cross sections. That curvature in the FIG. 6 view makes the surface groove 78's surface actually toroidal, although it appears cylindrical in FIGS. 5 and 6.

We have found that directing the sensor pattern downward and making it bimodal can markedly increase the reliability of a simple sensor system employed inside an enclosure. The present invention therefore constitutes a significant advance in the art.

What is claimed is:

1. An automatic-toilet system comprising:

A) a toilet including a toilet bowl;

B) a flusher, operable to flush the toilet bowl in response to flusher-control signals applied thereto;

C) a radiation-based object sensor forming a sensitivity pattern directed toward a region in front of the toilet, the component of the sensitivity pattern in a plane normal to a vertical plane having a minimum within a central region thereof that is less than 80% of values of pattern maxima on both sides of the central region; and D) a control circuit responsive to the sensor system for operating the flusher in response to characteristics of objects that the object sensor detects.

2. An automatic-toilet system as defined in claim 1 wherein, somewhere in a range between 2 inches and 15 inches behind front of the toilet, the percentage of the pattern between 3 inches and 12 inches above the toilet seat is at least 1.5 times the percentage of the pattern between 12 inches and 21 inches above the toilet seat.

3. An automatic-toilet system as defined in claim 1 wherein less than 12% of the sensitivity pattern extends above horizontal.

4. An automatic-toilet system as defined in claim 3 wherein, somewhere in a range between 2 inches and 15 inches behind front of the toilet, the percentage of the pattern between 3 inches and 12 inches above the toilet seat is at least 1.5 times the percentage of the pattern between 12 inches and 21 inches above the toilet seat.

5. An automatic-toilet system as defined in claim 3 wherein the pattern maxima are spaced apart by a distance between 3 inches and 14 inches somewhere within 30 inches in front of the toilet.

6. An automatic-toilet system as defined in claim 3 wherein the toilet has a front edge, below which less than 20% of the sensitivity pattern extends.

7. An automatic-toilet system as defined in claim 6 wherein the pattern maxima are spaced apart by a distance between 3 inches and 14 inches somewhere within 30 inches in front of the toilet.

8. An automatic-toilet system as defined in claim 1 wherein the pattern maxima are spaced apart by a distance between 3 inches and 14 inches somewhere within 30 inches in front of the toilet.

9. An automatic-toilet system as defined in claim 8 wherein, somewhere in a range between 2 inches and 15 inches behind front of the toilet, the percentage of the pattern between 3 inches and 12 inches above the toilet seat is at least 1.5 times the percentage of the pattern between 12 inches and 21 inches above the toilet seat.

10. An automatic-toilet system as defined in claim 1 wherein the sensitivity pattern is centered at an angle at least 5 degrees below horizontal.

11. An automatic-toilet system as defined in claim 10 wherein, somewhere in a range between 2 inches and 15 inches behind front of the toilet, the percentage of the pattern between 3 inches and 12 inches above the toilet seat is at least 1.5 times the percentage of the pattern between 12 inches and 21 inches above the toilet seat.

12. An automatic-toilet system as defined in claim 10 wherein the pattern maxima are spaced apart by a distance between 3 inches and 14 inches somewhere within 30 inches in front of the toilet.

13. An automatic-toilet system as defined in claim 10 wherein the toilet has a front edge, below which less than 20% of the sensitivity pattern extends.

14. An automatic-toilet system as defined in claim 13 wherein the pattern maxima are spaced apart by a distance between 3 inches and 14 inches somewhere within 30 inches in front of the toilet.

15. An automatic flusher adapted for installation into a toilet that includes a toilet bowl, the flusher comprising:

A) a flusher, operable in response to flusher-control signals applied thereto to flush the toilet bowl of a toilet in which it is installed;

B) a radiation-based object sensor forming a sensitivity pattern directed toward a region in front of the toilet, the component of the sensitivity pattern in a plane normal to a vertical plane having a minimum within a central region thereof that is less than 80% of values of pattern maxima on both sides of the central region; and C) a control circuit responsive to the sensor system for operating the flusher in response to characteristics of objects that the object sensor detects.

16. An automatic-toilet system as defined in claim 15 wherein, somewhere in a range between 2 inches and 15 inches behind front of the toilet, the percentage of the pattern between 3 inches and 12 inches above the toilet seat is at least 1.5 times the percentage of the pattern between 12 inches and 21 inches above the toilet seat.

17. An automatic flusher as defined in claim 15 wherein less than 12% of the sensitivity pattern extends above horizontal.

18. An automatic-toilet system as defined in claim 17 wherein, somewhere in a range between 2 inches and 15 inches behind front of the toilet, the percentage of the pattern between 3 inches and 12 inches above the toilet seat is at least 1.5 times the percentage of the pattern between 12 inches and 21 inches above the toilet seat.

19. An automatic flusher as defined in claim 17 wherein the pattern maxima are so disposed as to be spaced apart, when the flusher is installed into a toilet, by a distance between 3 inches and 14 inches somewhere within 30 inches in front of the toilet.

20. An automatic flusher as defined in claim 17 wherein, when the flusher is installed into a toilet having a front edge, less than 20% of the sensitivity pattern extends below the front edge.

21. An automatic flusher as defined in claim 20 wherein the pattern maxima are so disposed as to be spaced apart, when the flusher is installed into a toilet, by a distance between 3 inches and 14 inches somewhere within 30 inches in front of the toilet.

22. An automatic flusher as defined in claim 15 wherein the pattern maxima are so disposed as to be spaced apart, when the flusher is installed into a toilet, by a distance between 3 inches and 14 inches somewhere within 30 inches in front of the toilet.

23. An automatic-toilet system as defined in claim 22 wherein, somewhere in a range between 2 inches and 15 inches behind front of the toilet, the percentage of the pattern between 3 inches and 12 inches above the toilet seat is at least 1.5 times the percentage of the pattern between 12 inches and 21 inches above the toilet seat.

24. An automatic flusher as defined in claim 15 wherein the sensitivity pattern is centered at an angle at least 5 degrees below horizontal.

25. An automatic-toilet system as defined in claim 24 wherein, somewhere in a range between 2 inches and 15 inches behind front of the toilet, the percentage of the pattern between 3 inches and 12 inches above the toilet seat is at least 1.5 times the percentage of the pattern between 12 inches and 21 inches above the toilet seat.

26. An automatic flusher as defined in claim 24 wherein the pattern maxima are so disposed as to be spaced apart, when the flusher is installed into a toilet, by a distance between 3 inches and 14 inches somewhere within 30 inches in front of the toilet.

27. An automatic flusher as defined in claim 24 wherein, when the flusher is installed into a toilet having a front edge, less than 20% of the sensitivity pattern extends below the front edge.

28. An automatic flusher as defined in claim 27 wherein the pattern maxima are so disposed as to be spaced apart, when the flusher is installed into a toilet, by a distance between 3 inches and 14 inches somewhere within 30 inches in front of the toilet.

* * * * *